US007244886B2

(12) United States Patent
Hosler

(10) Patent No.: US 7,244,886 B2
(45) Date of Patent: Jul. 17, 2007

(54) INVISIBLE ELECTROMAGNETIC PICKUP FOR A STRINGED MUSICAL INSTRUMENT

(75) Inventor: David Hosler, El Cajon, CA (US)

(73) Assignee: Taylor-Listug, Inc., El Cajon, CA (US)

( * ) Notice: Subject to any disclaimer, the term of this patent is extended or adjusted under 35 U.S.C. 154(b) by 125 days.

(21) Appl. No.: 10/738,743

(22) Filed: Dec. 16, 2003

(65) Prior Publication Data

US 2005/0126376 A1 Jun. 16, 2005

(51) Int. Cl.
*G10H 3/18* (2006.01)

(52) U.S. Cl. ..... 84/726; 84/725

(58) Field of Classification Search ..... 84/723–734
See application file for complete search history.

(56) References Cited

U.S. PATENT DOCUMENTS

| | | | | | |
|---|---|---|---|---|---|
| 1,870,576 | A | * | 8/1932 | Knoblaugh | 84/726 |
| 2,455,046 | A | * | 11/1948 | De Armond | 84/726 |
| 2,581,653 | A | * | 1/1952 | Grimshaw | 84/727 |
| 3,177,283 | A | * | 4/1965 | Fender | 84/726 |
| 3,711,619 | A | | 1/1973 | Jones et al. | |
| 4,050,341 | A | | 9/1977 | Underwood | |
| 4,145,944 | A | * | 3/1979 | Helpinstill, II | 84/726 |
| 4,269,103 | A | * | 5/1981 | Underwood | 84/726 |
| 4,378,722 | A | * | 4/1983 | Isakson | 84/726 |
| 4,408,513 | A | | 10/1983 | Clevinger | |
| 4,499,809 | A | | 2/1985 | Clevinger | |
| 4,765,219 | A | * | 8/1988 | Alm | 84/726 |
| 5,027,691 | A | * | 7/1991 | Kennedy | 84/727 |
| 5,321,201 | A | * | 6/1994 | Noreen | 84/735 |
| 5,389,731 | A | | 2/1995 | Lace | |
| 5,399,802 | A | * | 3/1995 | Blucher | 84/726 |
| 5,430,246 | A | * | 7/1995 | Lace et al. | 84/726 |
| 5,461,193 | A | | 10/1995 | Schertler | |
| 5,525,750 | A | * | 6/1996 | Beller | 84/726 |
| 5,530,199 | A | * | 6/1996 | Blucher | 84/728 |
| 5,641,932 | A | | 6/1997 | Lace | |
| 5,811,710 | A | * | 9/1998 | Blucher et al. | 84/728 |
| 6,051,765 | A | * | 4/2000 | Regenberg et al. | 84/293 |
| 6,627,808 | B1 | * | 9/2003 | Coats et al. | 84/723 |
| 6,897,369 | B1 | * | 5/2005 | Lace | 84/727 |

FOREIGN PATENT DOCUMENTS

| | | | | | |
|---|---|---|---|---|---|
| JP | 404347897 | A | * | 12/1992 | 84/731 |

* cited by examiner

*Primary Examiner*—Lincoln Donovan
*Assistant Examiner*—David S. Warren
(74) *Attorney, Agent, or Firm*—Peter K. Hahn; Luce, Forward, Hamilton & Scripps, LLP

(57) ABSTRACT

The present invention provides an electromagnetic pickup comprising a bobbin, a single coil wound around the bobbin and at least one pole piece coupled to the bobbin. The pickup is adapted for use with a stringed musical instrument including a body portion, a neck portion and a plurality of strings. In operation, the pickup is disposed between the neck and body portions of the musical instrument such that the pickup is substantially invisible to a user of the musical instrument.

22 Claims, 8 Drawing Sheets

INVISIBLE ELECTROMAGNETIC PICKUP FOR A STRINGED MUSICAL INSTRUMENT

FIELD OF THE INVENTION

The present invention is directed to an invisible electromagnetic pickup for a stringed musical instrument.

BACKGROUND OF THE INVENTION

Electromagnetic pickups are commonly used to sense string vibrations of musical instruments and convert the vibrations into electrical signals. These electrical signals can be amplified or otherwise modified before being converted back into acoustic energy. Various pickup arrangements have been developed to achieve sound amplification together with an acceptable tone quality.

Most conventional pickups include a plurality of pole pieces and a coil disposed beneath the magnetizable strings of the musical instrument on the top surface or soundboard. The vibration of the magnetizable strings cause disturbances in the magnetic fields of the pole pieces inducing current in the coil. Other pickups include a single elongate magnet and a coil disposed beneath the strings of the musical instrument, wherein a surface of the magnet may be tapered or stepped to vary the magnetic field affecting the assorted strings.

A problem associated with conventional pickups concerns their location on the top surface of the musical instrument. Since pickups must be placed near the strings in order to be effective, the obvious choice for pickup location is underneath the strings on the top surface of the musical instrument. However, this may alter the appearance of an otherwise aesthetically pleasing musical instrument design. In view of this problem, there exists a need for pickup for a musical instrument that is invisible so that it does not affect the appearance of the musical instrument.

SUMMARY OF THE INVENTION

The present invention provides a musical instrument including an electromagnetic pickup that is substantially invisible to a user. The pickup is shaped and sized to fit within a recessed area in the body portion of the musical instrument such that it is sandwiched between the body and neck portions. The pickup can be easily accessed for repair or replacement by removing the neck portion.

One aspect of the present invention involves an invisible pickup comprising a bobbin, a single coil wound around the bobbin and at least one pole piece coupled to the bobbin. The pickup is adapted for use with a stringed musical instrument including a body portion, a neck portion and a plurality of strings. In operation, the pickup is disposed under the fretboard between the neck and body portions of the musical instrument such that it is substantially invisible to a user. Each of the pole pieces is disposed substantially adjacent a respective musical instrument string. The neck portion includes an interior surface having a cut out dimensioned to receive the pickup, and the body portion includes a top surface having a recessed area dimensioned to receive the pickup. Optionally, the recessed area includes a plurality of substantially circular apertures dimensioned to receive the pole pieces.

An additional aspect of the present invention involves a six-string guitar including a body portion, a neck portion and a pickup including 5 pole pieces, each pole piece disposed substantially adjacent a respective string. Since the guitar includes 6 strings, one string does not include an associated pole piece. The string without an associated pole piece is a treble string.

A further aspect of the present invention involves an invisible pickup for a musical instrument comprising a bobbin, a single coil wound around the bobbin, at least one pole piece coupled to the bobbin and an elongate metal bar embedded within the bobbin. The metal bar optionally comprises a thicker section and a thinner section separated by a step, wherein the metal bar is adapted to vary the magnetic mass adjacent the musical instrument strings in accordance with the relative magnetization of each string.

Another aspect of the present invention involves a pickup comprising a bobbin, a single coil wound around the bobbin, at least one pole piece coupled to the bobbin and a spacer disposed between the bobbin and one of the pole pieces.

Yet another aspect of the present invention involves a pickup comprising a bobbin, a single coil wound around the bobbin and a single elongate pole piece, wherein the musical instrument includes a recessed area in a top surface of the body portion including an aperture shaped and sized to receive the elongate pole piece.

These and other features and advantages of the present invention will be appreciated from review of the following detailed description of the invention, along with the accompanying figures in which like reference numerals refer to like parts throughout.

DETAILED DESCRIPTION

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Figure 1:
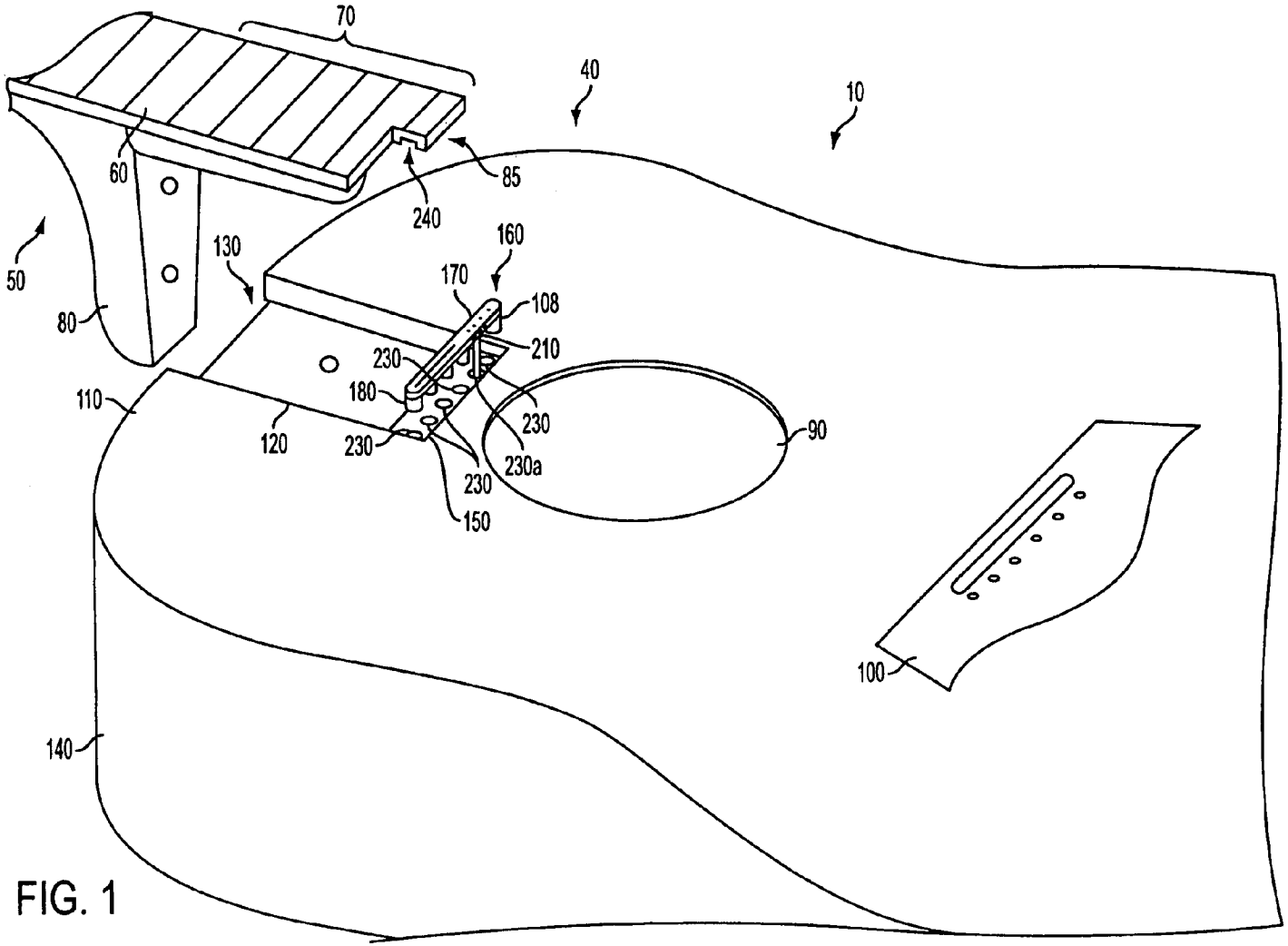
FIG. 1 is an expanded perspective view of an acoustic guitar including a pickup in accordance with the principles of the present invention.
Figure 2:
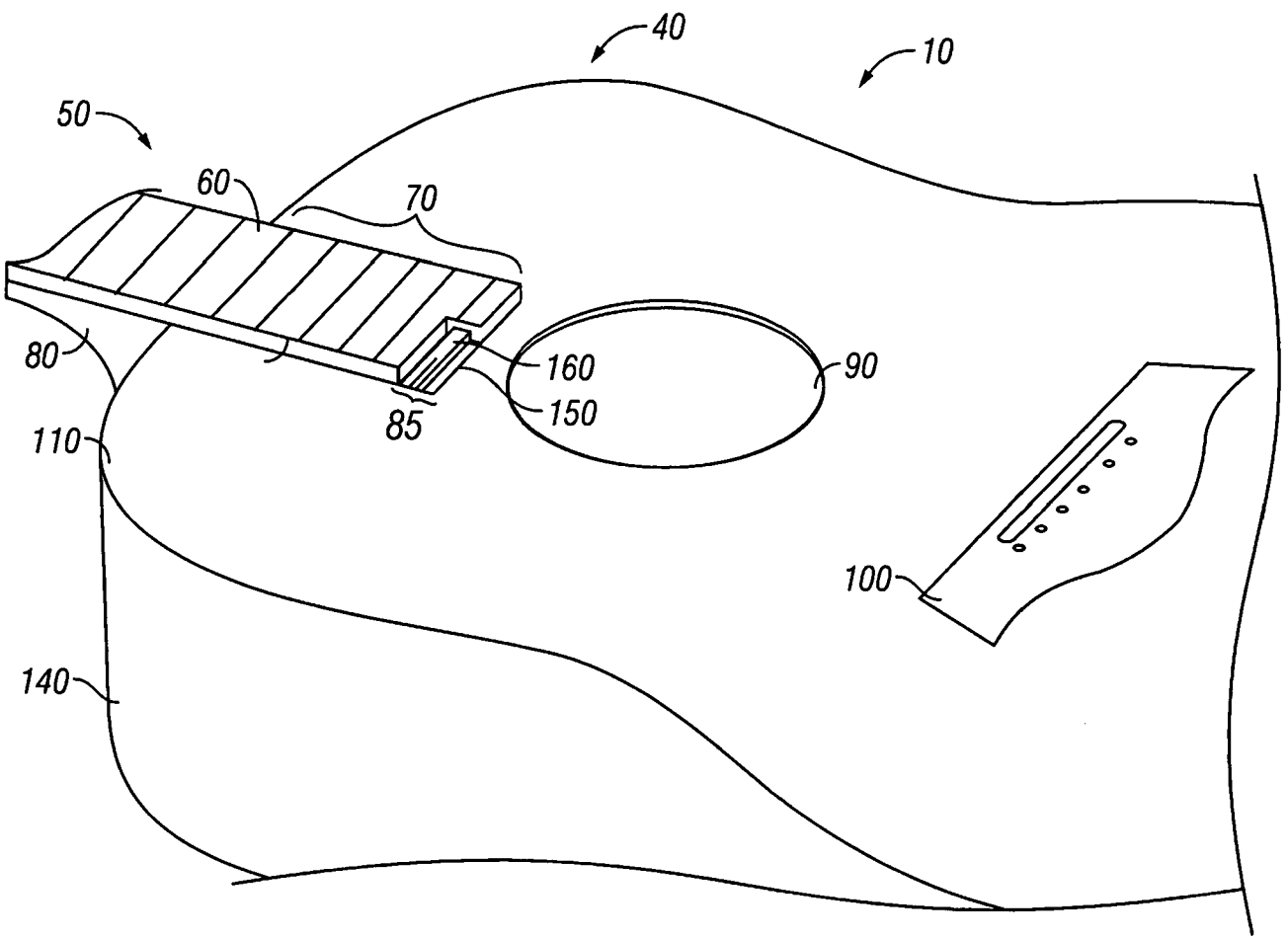
FIG. 2 is a perspective view of an acoustic guitar including a pickup in accordance with the principles of the present invention.

FIGS. 1 and 2 show an acoustic guitar 10 in accordance with the principles of the present invention. Guitar 10 comprises a body portion 40 and a neck portion 50 including a fretboard 60, a tail 70 and a heel 80. A portion of the fretboard located at a distal end 85 of the tail 70 has been removed to help illustrate some of the features of the present invention. The guitar body portion 40 comprises a hollow body including a sound port 90 and bridge 100 on its top surface 110. In addition, the body portion 40 includes a pair of recesses 120,130 in the top 110 and side 140 surfaces, respectively, for attachment of the neck portion 50. More particularly, the tail 70 mates with recess 120 and the heel 80 mates with recess 130. Suitable means for attaching the neck portion 50 to the body portion 40 include fasteners that pass from the internal cavity of the body portion 40 into the tail 70 and heel 80 as disclosed in U.S. Pat. No. 6,051,766 to Taylor, which is hereby incorporated by reference in its entirety. Advantageously, adhesives such as glue are not used to attach the neck portion 50 so that the neck can be readily detached from the body portion 40 permitting access to the pickup 160.

According to an aspect of the present invention, the top surface 110 includes a recessed area 150 dimensioned to receive an invisible electromagnetic pickup 160. Recessed area 150 is disposed within recess 120 adjacent sound port 90. As shown in FIG. 2, when the guitar 10 is fully assembled, the pickup 160 is disposed beneath the fretboard 60 such that it is hidden from view, thus providing a more aesthetically pleasing appearance. The pickup 160 can be easily accessed for repair or replacement by removing the neck portion 50 from the body portion 40. As will be appreciated by those of skill in the musical arts, the invisible electromagnetic pickup 160 can be used with other stringed musical instruments, including, but not limited to, violins, cellos, basses, sitars, mandolins and violas, without departing from the scope of the present invention. The pickup 160 may be any pickup suitable for use with a musical instrument having magnetizable strings.

Figure 3A:
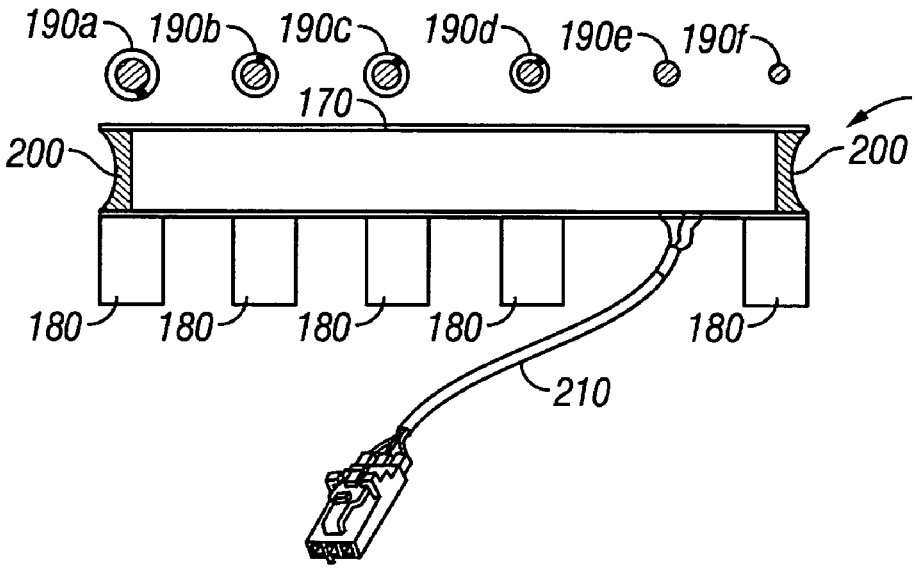
FIGS. 3A and 3B are cross-sectional and perspective views, respectively, of a pickup in accordance with the principles of the present invention.
Figure 3B:
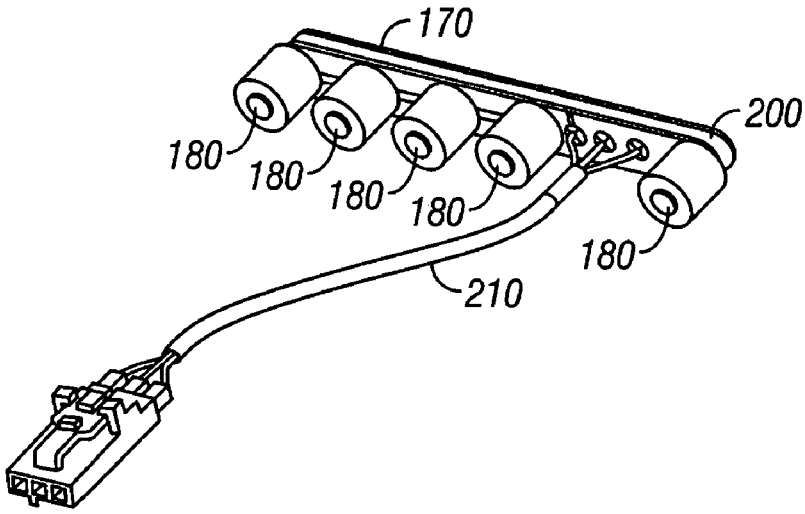

Referring to FIGS. 3A and 3B, according to a preferred embodiment, the pickup 160 comprises a bobbin 170 and at least one pole piece 180 coupled thereto. Each pole piece 180 is preferably a permanent magnet disposed substantially beneath a respective guitar string 190*a-f*. In the illustrated embodiment, pickup 160 includes five cylindrical pole pieces 180 corresponding to strings 190*a-d,f*. Of course, as will be appreciated by those of skill in the musical arts, the pole pieces 160 may be shapes other than cylindrical without departing from the scope of the present invention. Bobbin 170 is preferably made from a durable plastic material such as LEXAN.

The guitar strings 190 have varying degrees of magnetization due to differences in string materials and diameters such that sounds produced by high strings 190*d-f* are normally more dominant than those produced by low strings 190*a-c*. To provide a natural tone while achieving a balanced response from each string, string 190*e* preferably does not have an associated pole piece. However, according to other embodiments, string 190*e* may have an associated pole piece that is modified to produce a varying magnetic field in accordance with the relative magnetizability of the string. According to some embodiments of the present invention, strings 190*d,e* may have associated pole pieces that are smaller in size than the other pole pieces 180. Alternatively, strings 190*d,e* may have pole pieces that are spaced further apart from the bobbin 160.

Pickup 160 further comprises a single coil 200 wound many times around bobbin 170. In operation, the vibration of strings 190 causes changes in the magnetic fields of the pole pieces 180, which in turn induces current in the coil 200. The induced current is then fed to conventional amplifying equipment through lead wires 210. In this manner, the acoustic guitar 10 can be electronically amplified while retaining the natural tone quality of the strings 190.

Referring again to FIG. 1, recessed area 150 includes a plurality of apertures 230 dimensioned to receive pole pieces 160. In the illustrated embodiment, there are four circular apertures 230 corresponding to the four pole pieces 160. The recessed area 150 optionally includes an additional aperture 230*a* that can be used for the passage of lead wires 210 or an additional pole piece, if applicable. In addition, the interior surface of the distal end 85 of the tail 70 includes a cut out 240 dimensioned to receive bobbin 170. As shown in FIG. 2, when neck portion 50 is attached to body-portion 40, the fretboard 60 obscures the presence of pickup 160 making it invisible during use.

As disclosed above, the guitar strings 190 have varying degrees of magnetization due to differences in materials and thicknesses. FIGS. 4-6 show exemplary pickups embodiments, suitable for use with the guitar 10 of the present invention, that compensate for these differences by varying the magnetic fields produced by the pole pieces 160. In FIGS. 4-6, elements similar to those in FIGS. 3A and 3B have been numbered accordingly.

Figure 4A:
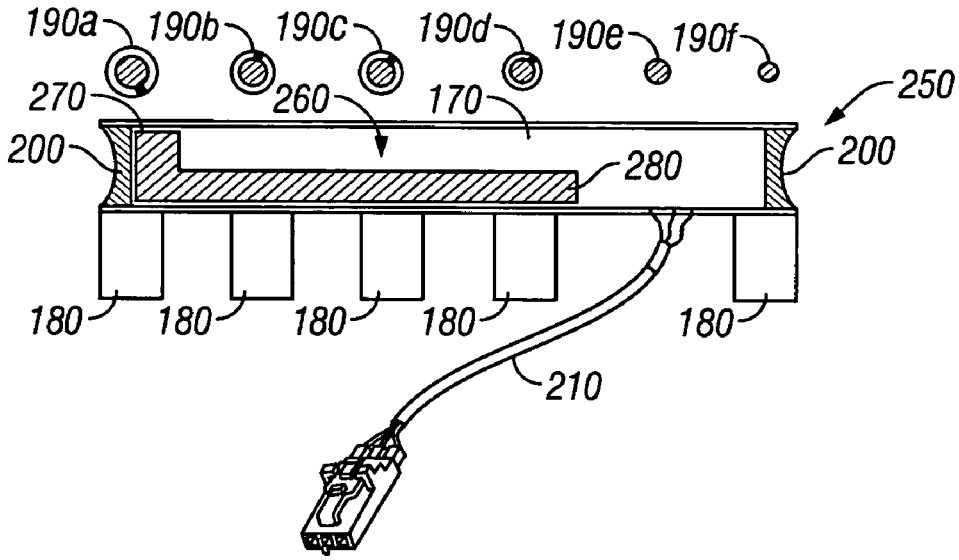
FIGS. 4A and 4B are cross-sectional and partially exploded perspective views, respectively, of another pickup in accordance with the principles of the present invention.
Figure 4B:
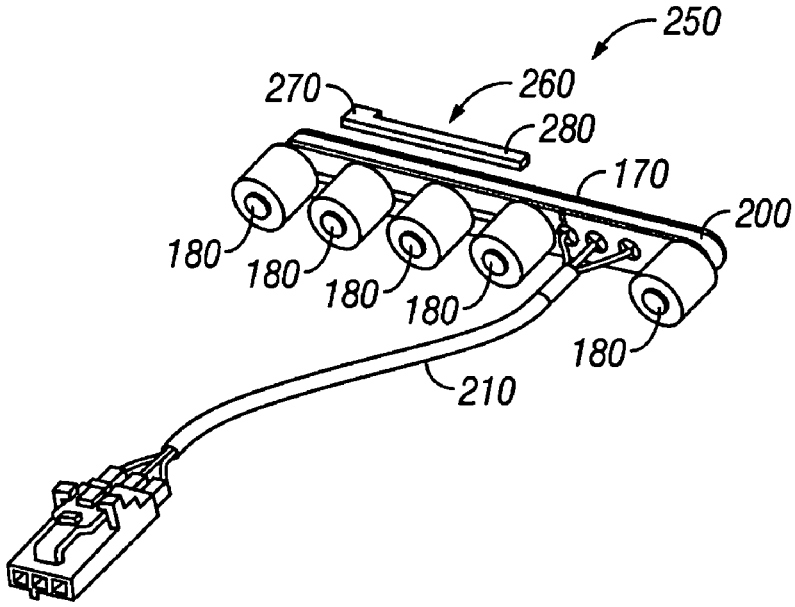

FIGS. 4A and 4B show a pickup 250 providing varying magnetic fields relative to the magnetization of the strings 190. The pickup 250 is similar to pickup 160 shown in FIGS. 3A and 3B, but further comprises an elongate metal bar 260 embedded within bobbin 170. Metal bar 260 comprises two sections separated by a single step including a thicker section 270 disposed substantially beneath string 190*a* and thinner section 280 disposed substantially beneath strings 190*b-d*. Metal bar 260 effectively varies the magnetic mass adjacent strings 190 in accordance with the relative magnetization of each string 190. Like pickup 160, pickup 250 is dimensioned to be disposed between neck portion 50 and body portion 40 of guitar 10 such that it is substantially hidden from sight. According to other embodiments, the metal bar 260 includes a gradual taper from a thicker end under string 190*a* to a thinner end under string 190*d*. Alternatively, the metal bar 260 may contain a plurality of steps, wherein the thickest step is disposed substantially underneath string 190*a* and the thinnest step disposed adjacent string 190*d*.

Figure 5A:
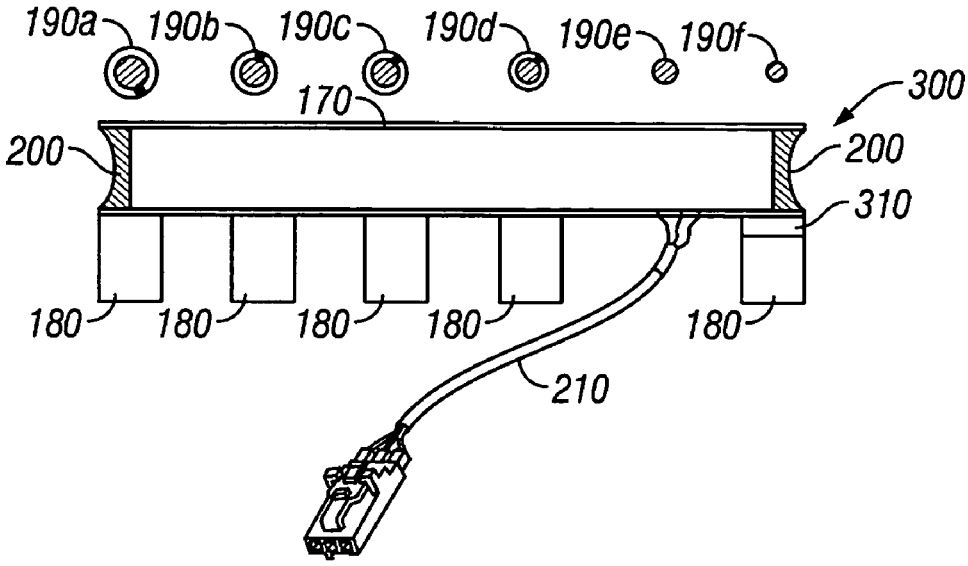
FIGS. 5A and 5B are cross-sectional and perspective views, respectively, of a further pickup in accordance with the principles of the present invention.
Figure 5B:
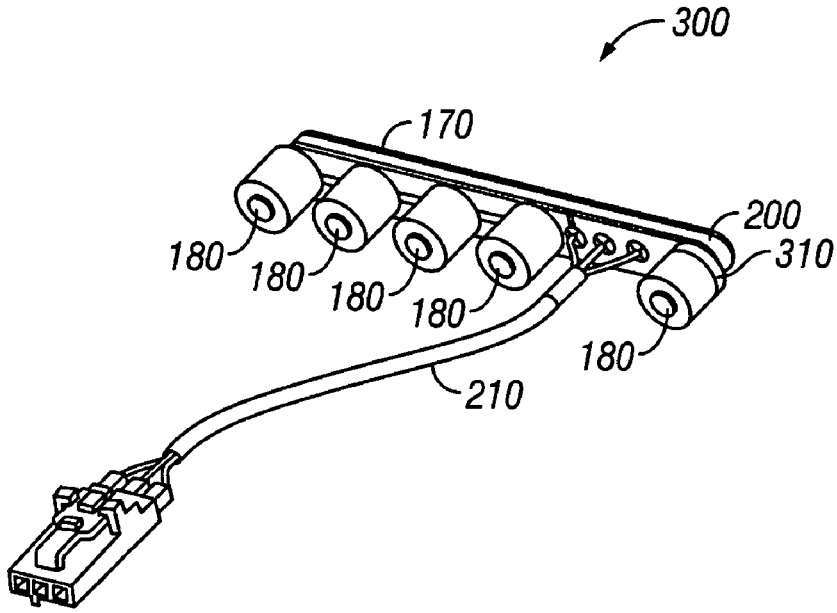

FIGS. 5A and 5B show another pickup 300 providing varying magnetic fields relative to the magnetization of the strings 190. The pickup 300 is similar to pickup 160 shown in FIGS. 3A and 3B, but further comprises a spacer 310 disposed between high string 190*f* and its associated pole piece 180. As explained above, the sounds produced by the high strings 190*d-f* are normally more dominant than those produced by low strings 190*a-c*. Spacer 310 increases the distance between the string 190*f* and its associated pole piece 180, effectively reducing the magnetic mass adjacent string 190*f* in accordance with the higher magnetizability of string 190*f*. Spacer 310 is preferably made of a non-magnetic material such as, by way of example, plastic or wood. Similar to previous embodiments, pickup 300 is shaped and sized to be disposed between neck portion 50 and body portion 40 of guitar 10 such that it is substantially hidden from sight. Although the illustrated embodiment shows only one spacer 310 associated with pole string 190*f*, it should be appreciated by those of skill in the art that one or more additional spacers of differing thicknesses may be employed to vary the magnetic mass adjacent strings 190, without departing from the scope of the present invention. By way of example, high strings 190*d,e* may also have associated pole pieces that are spaced apart from the strings using spacers 310.

Figure 6A:
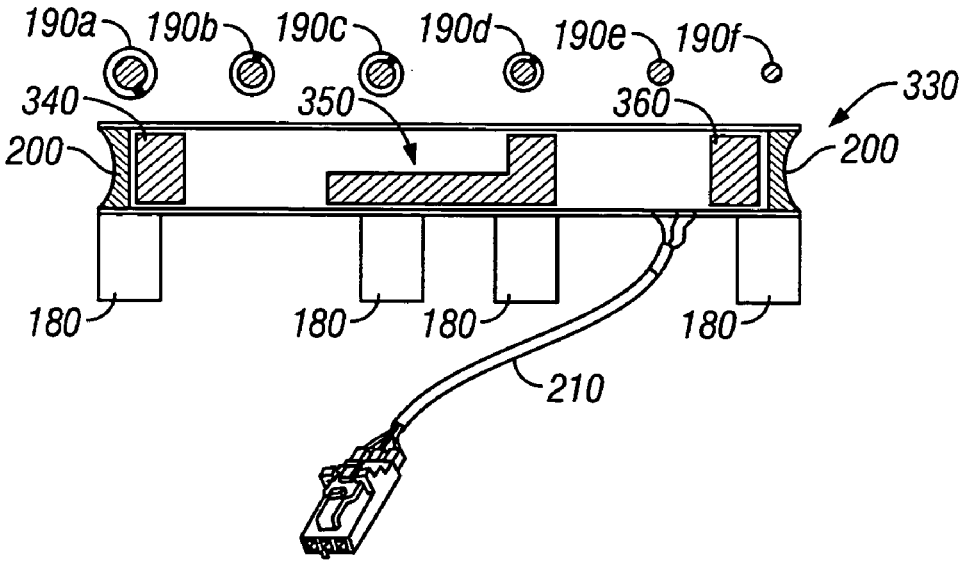
FIGS. 6A and 6B are cross-sectional and partially exploded perspective views, respectively, of an additional pickup in accordance with the principles of the present invention.
Figure 6B:
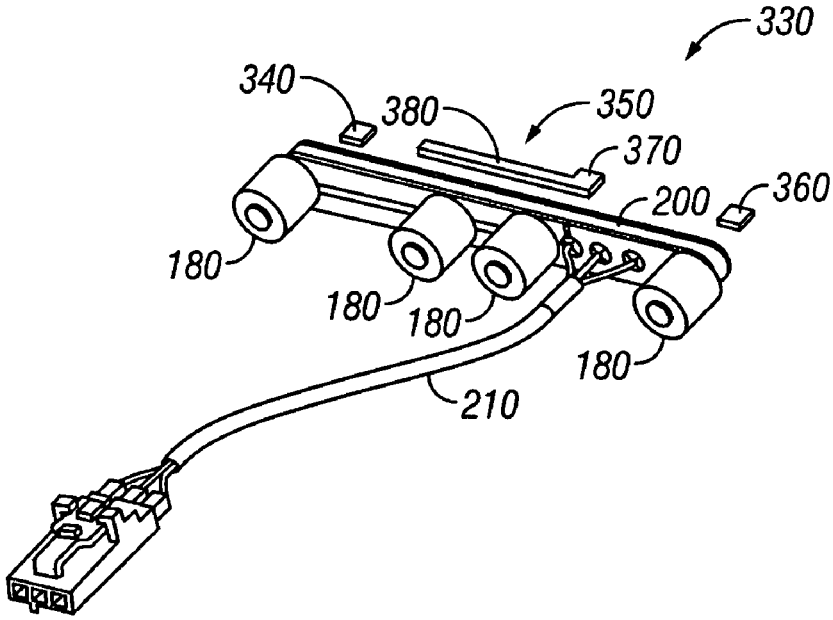

FIGS. 6A and 6B show an additional pickup 330 providing varying magnetic fields relative to the magnetization of strings 190. Pickup 330 is similar to pickup 160 shown in FIGS. 3A and 3B, but further comprises three metal bars 340,350,360 embedded within bobbin 170. In addition, pickup 330 has only four pole pieces 180 associated with strings 190*a,c,d,f*. Metal bars 340,360 are individual rectangular pieces disposed substantially beneath strings 190*a,f*, respectively. Metal bar 350 comprises two sections separated by a single step and including a thicker section 370 disposed substantially beneath string 190*c* and thinner section 380 disposed substantially beneath strings 190*d*. This pickup structure is particularly well suited for a 12-string pickup. Of course, pickup 330 is also dimensioned to be disposed between neck portion 50 and body portion 40 of guitar 10 so that it is substantially invisible to the user.

Figure 7:
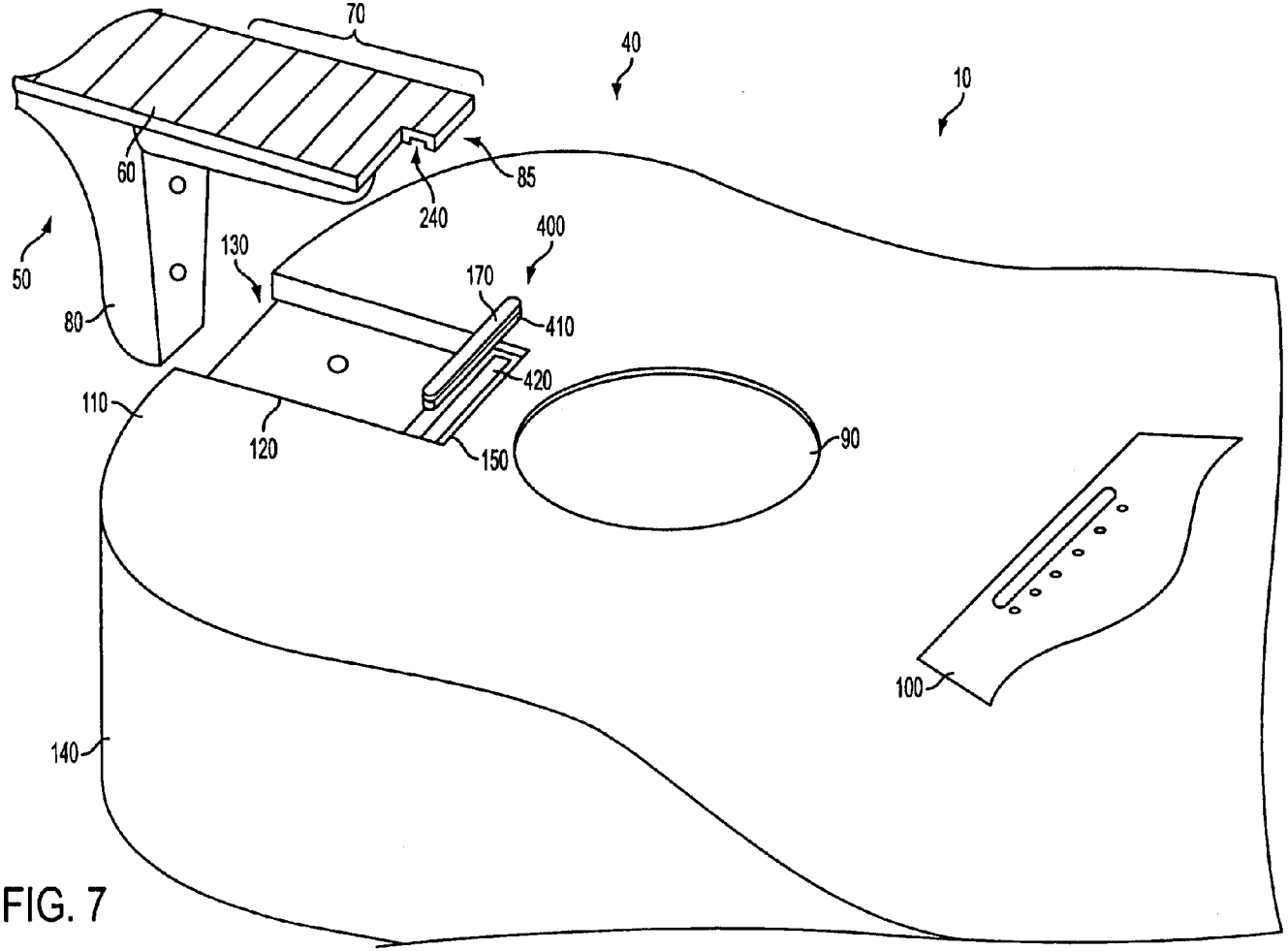
FIG. 7 is a perspective view of an acoustic guitar including an alternative pickup in accordance with the principles of the present invention.
Figure 8:
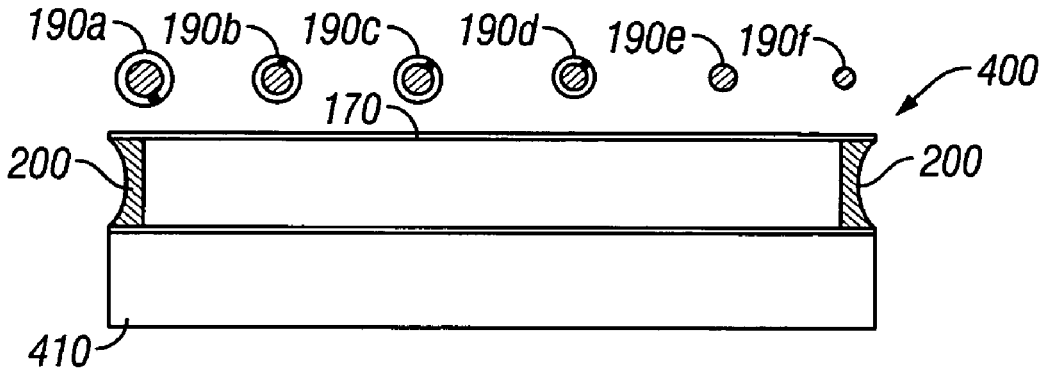
FIG. 8 is a cross-sectional view of an alternative pickup in accordance with the principles of the present invention.

FIGS. 7 and 8 show a pickup 400 for a guitar 10 according to an alternative embodiment of the present invention, wherein elements similar to those in FIGS. 1-3 have been numbered accordingly. As best seen in FIG. 7, pickup 400 comprises bobbin 170 including coil 200 and a single elongate pole piece 410 coupled thereto. Pole piece 410 is preferably a permanent magnet spanning the length of bobbin 170 such that, in operation, pole piece 410 is disposed substantially beneath guitar strings 190*a-f*. Pickup 400 may optionally includes lead wires (not shown) for connection to amplifying equipment.

As seen in FIG. 7, recessed area 150 includes an aperture 420 shaped and sized to receive elongate pole piece 410, and the underside of the distal end 85 of tail 70 includes a cut out 240 dimensioned to receive bobbin 170. Thus, when the neck portion 50 is attached to body portion 40, the fretboard 60 obscures the presence of pickup 160 making it invisible. According to other embodiments, pickup 400 accounts for the variance in magnetizability of strings 190 by including a gradual taper from a thicker end under string 190*a* to a thinner end under string 190*d*. Alternatively, the metal bar pole piece 410 may include a plurality of steps, wherein the thickest step is disposed substantially underneath string 190*a* and the thinnest step disposed adjacent string 190*d*.

For those skilled in the art, it will be apparent that the strength and tone of the strings output can be varied by adjusting the size, dimensioning and placement of the bobbin, metal inserts within the bobbin, magnets and spacers.

Thus, it is seen that an invisible electromagnetic pickup for a stringed musical instrument is provided. One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

What is claimed is:

1. An electromagnetic pickup in combination with a stringed musical instrument including a body portion, a removable neck portion and a plurality of strings, the pickup comprising:

a bobbin;

a coil wound around the bobbin; and at least one pole piece coupled to the bobbin;

wherein the bobbin is configured to be adjacent the strings and the bobbin defines a volume that is void of magnetic material, wherein the pickup is disposed between the removable neck and body portions of the musical instrument such that the pickup is exposed when the removable neck is disengaged from the body portion and such that the pickup is substantially hidden when the removable neck is engaged with the body portion.

2. The electromagnetic pickup of claim 1, wherein each of the at least one pole piece is disposed substantially aligned with a respective musical instrument string.

3. The electromagnetic pickup of claim 2, wherein the musical instrument further comprises a recessed area in a top surface of the body portion dimensioned to receive the pickup.

4. The electromagnetic pickup of claim 3, wherein the recessed area includes an aperture dimensioned to receive each pole piece.

5. The electromagnetic pickup of claim 4, wherein each aperture is substantially circular.

6. The electromagnetic pickup of claim 1, wherein the neck portion includes an interior surface having a cut out dimensioned to receive a portion of the pickup.

7. The electromagnetic pickup of claim 1, wherein:

the musical instrument includes 6 strings; and the at least one pole piece includes 5 pole pieces, each pole piece disposed substantially aligned with a respective string.

8. The electromagnetic pickup of claim 7, wherein the string that does not include an associated pole piece is a treble string.

9. The electromagnetic pickup of claim 1, wherein the pickup further comprises lead wires for attachment to amplification equipment.

10. The electromagnetic pickup of claim 1, wherein the pole pieces are substantially cylindrical.

11. The electromagnetic pickup of claim 1, wherein the musical instrument is a guitar.

12. The electromagnetic pickup of claim 1, further comprising a spacer disposed between the bobbin and one of the pole pieces.

13. The electromagnetic pickup of claim 1, wherein the at least one pole piece comprises a single elongate pole piece disposed substantially aligned with two or more of the strings.

14. The electromagnetic pickup of claim 13, wherein the musical instrument further comprises a recessed area in a top surface of the body portion dimensioned to receive the pickup.

15. The electromagnetic pickup of claim 14, wherein the recessed area includes an aperture dimensioned to receive the single elongate pole piece.

16. A stringed musical instrument including an electromagnetic pickup, comprising:

a body portion including a recessed area shaped and sized to receive the pickup; and a neck portion removably attached to the body portion such that the pickup is sandwiched between the removable neck and body portions;

wherein the pickup includes a bobbin, a coil wound around the bobbin, and at least one pole piece coupled to the bobbin, wherein the bobbin is configured to be adjacent strings of the musical instrument and the bobbin defines a volume that is void of magnetic material, and wherein the pickup is substantially invisible to a user of the musical instrument.

17. An electromagnetic pickup comprising:

a non-magnetic bobbin having a top surface and a bottom surface, the bobbin being configured to be disposed adjacent strings of a stringed instrument;

a coil wound around the bobbin; and at least one pole piece fixedly coupled to the bottom surface of the bobbin, wherein the bobbin defines a volume that is void of magnetic material.

18. The electromagnetic pickup of claim 17, further comprising a non-magnetic spacer disposed between the bobbin and the at least one pole piece, wherein the at least one pole piece is fixedly coupled to a bottom surface of the bobbin such that the spacer is interposed between the at least one pole piece and the bottom surface.

19. The electromagnetic pickup of claim 17, wherein the bobbin is elongate.

20. The electromagnetic pickup of claim 19, wherein the at least one pole piece comprises a single elongate pole piece.

21. The electromagnetic pickup of claim 17, wherein the pickup further comprises lead wires for attachment to amplification equipment.

22. The electromagnetic pickup of claim 17, wherein each pole piece is substantially cylindrical.

* * * * *